US005326232A

United States Patent [19]

McDonnel et al.

[11] Patent Number: 5,326,232

[45] Date of Patent: Jul. 5, 1994

[54] TWO STAGE PUMP ASSEMBLY WITH MECHANICAL DISCONNECT

[75] Inventors: David A. McDonnel, Speedway; Karl L. Swartout, Mooresville, both of Ind.

[73] Assignee: General Motors Corporation, Detroit, Mich.

[21] Appl. No.: 49,082

[22] Filed: Apr. 20, 1993

[51] Int. Cl.[5] ..... F04B 9/00

[52] U.S. Cl. ..... 417/319; 417/429

[58] Field of Search ..... 417/244, 247, 199.1, 417/319, 426, 429

[56] References Cited

U.S. PATENT DOCUMENTS

| | | | |
|---|---|---|---|
| 2,669,933 | 2/1954 | Bayles | 417/199.1 |
| 2,781,727 | 2/1957 | Marshall et al. | 417/199.1 |
| 3,643,434 | 2/1972 | Widmaier | 417/429 |
| 3,754,626 | 8/1973 | Heidorn | 417/319 |
| 3,904,318 | 9/1975 | Born et al. | 417/199.1 |
| 4,416,588 | 11/1983 | Karliner | 417/429 |
| 4,420,289 | 12/1983 | Sihouette | 417/319 |
| 4,553,914 | 11/1985 | Noell et al. | 417/319 |
| 4,619,592 | 10/1986 | Bender | 417/429 |

*Primary Examiner*—Richard A. Bertsch
*Assistant Examiner*—Michael I. Kocharov
*Attorney, Agent, or Firm*—Donald F. Scherer

[57] ABSTRACT

A two stage main pump has a first pump portion that is drivingly connected to an input shaft and a second pump that is drivingly connectable with the input shaft by a speed sensitive mechanism. The speed sensitive mechanism is urged by a resilient member to connect the second pump portion with the input shaft as well as to a centrifugal flyweight mechanism that is responsive to the rotary speed of the input shaft in order to urge a disconnection of the second pump from the input shaft.

5 Claims, 1 Drawing Sheet

TWO STAGE PUMP ASSEMBLY WITH MECHANICAL DISCONNECT

The invention herein described was made in the course of work under a contract or sub-contract thereunder with the Department of the Army.

TECHNICAL FIELD

The present invention relates generally to control pumps for use in conjunction with vehicular transmissions. More particularly, the present invention relates to the drive mechanisms for such pumps. Specifically, the present invention relates to pump drive mechanisms which accommodate multiple pumps.

BACKGROUND OF THE INVENTION

The main supply pumps in transmissions are generally geared directly to the engine, and the output flow of such supply pumps is, therefore, proportional to the speed of the engine. The flow requirements of the transmission, on the other hand, are not generally a function of engine speed. Accordingly, the supply pump for an automatic transmission has heretofore been sized to provide the transmission flow requirement at engine idle speed. This design approach results in excess capacity at elevated engine speeds. Thus, a considerable amount of power is wasted at higher pump speeds when the excess fluid must be exhausted through a system relief valve.

The prior art systems have attempted to reduce this loss by using variable displacement vane pumps and two stage pumps. While variable displacement pumps will reduce the power requirements at high speeds, such pump assemblies are considerably more expensive than two stage pumps. For that reason the most common solution has been to adopt and use two stage pumps. In two stage pump mechanisms, the first stage pump provides continuous fluid flow whenever the engine is operating. On the other hand, the second stage pump flow is directed into the main circuit, or dumped to sump, depending on the requirements of the transmission. Dumping a large amount of oil to sump still requires a significant amount of power. To reduce the power requirement of the second stage even further, the pump inlet is connected to atmosphere in order to ingest air into the pump instead of oil. This solution is noisy, complicates the control mechanism and retards the response of the second stage pump when its fluid flow is required from the second stage pump.

SUMMARY OF THE INVENTION

It is, therefore, a primary object of the present invention to provide an improved, two stage pump having one stage that selectively disconnects from the input drive of the pump.

It is another object of the present invention to provide an improved, two stage pump wherein one stage is controlled by a speed sensitive drive engaging mechanism.

It is a further object of the present invention to provide an improved, two stage pump wherein one stage is selectively engaged with the input shaft by drive tangs that are extended and retracted by an axially moveable rod member.

These and other objects of the invention, as well as the advantages thereof over existing and prior art forms, which will be apparent in view of the following detailed specification, are accomplished by means hereinafter described and claimed.

In general, the present invention seeks to retain the advantages of the two stage and output driven pumps while reducing the power requirement of these systems. To that end the present invention incorporates a two stage pump having a mechanical disconnect for one of the stages. The first stage pump, which may include one or more pumping mechanisms, is continuously driven by the engine, or transmission input, to supply a continuous flow of oil to the transmission. The second stage pump supplements the oil flow of the first stage when the input speed is at, or below, a predetermined value. A speed sensitive mechanism is operable to connect, and disconnect, the second stage pump to the input drive shaft. The speed sensitive mechanism has a plurality of drive connecting tangs that extend and retract in response to the input speed.

The speed sensitive mechanism has a spring biased actuating rod that rotates with the input shaft. The actuating rod is axially translated in response to a centrifugal flyweight mechanism that is operable in response to the rotational speed of the input shaft. A plurality of radially disposed recesses are alignable with the drive connecting tangs at a predetermined axial position of the actuating rod to permit the drive tangs to disconnect from one of the pump members. When the drive tangs are disconnected, the pump elements of the second stage are no longer active, thereby reducing the amount of oil pumped and accordingly reducing the hydraulic losses in the system.

When the pump is a gear type pump, one gear member is rotatably mounted on the pump input shaft by needle bearings, and the other gear member is rotatably mounted on a secondary shaft by needle bearings. With the tangs disconnected, the gear members are freely supported on their respective shafts. The output port of the disengaged pump may be closed by a conventional valve mechanism, such as a check valve or a solenoid valve, to prevent leakage losses in the system.

One exemplary embodiment of a two stage pump embodying the concepts of the present invention, and adapted for use with a power transmission, is deemed sufficient to effect a full disclosure of the subject invention, is shown by way of example in the accompanying drawings and is described in detail without attempting to show all of the various forms and modifications in which the invention might be embodied; the invention being measured by the appended claims and not by the details of the specification.

DESCRIPTION OF AN EXEMPLARY EMBODIMENT

Figure 1:
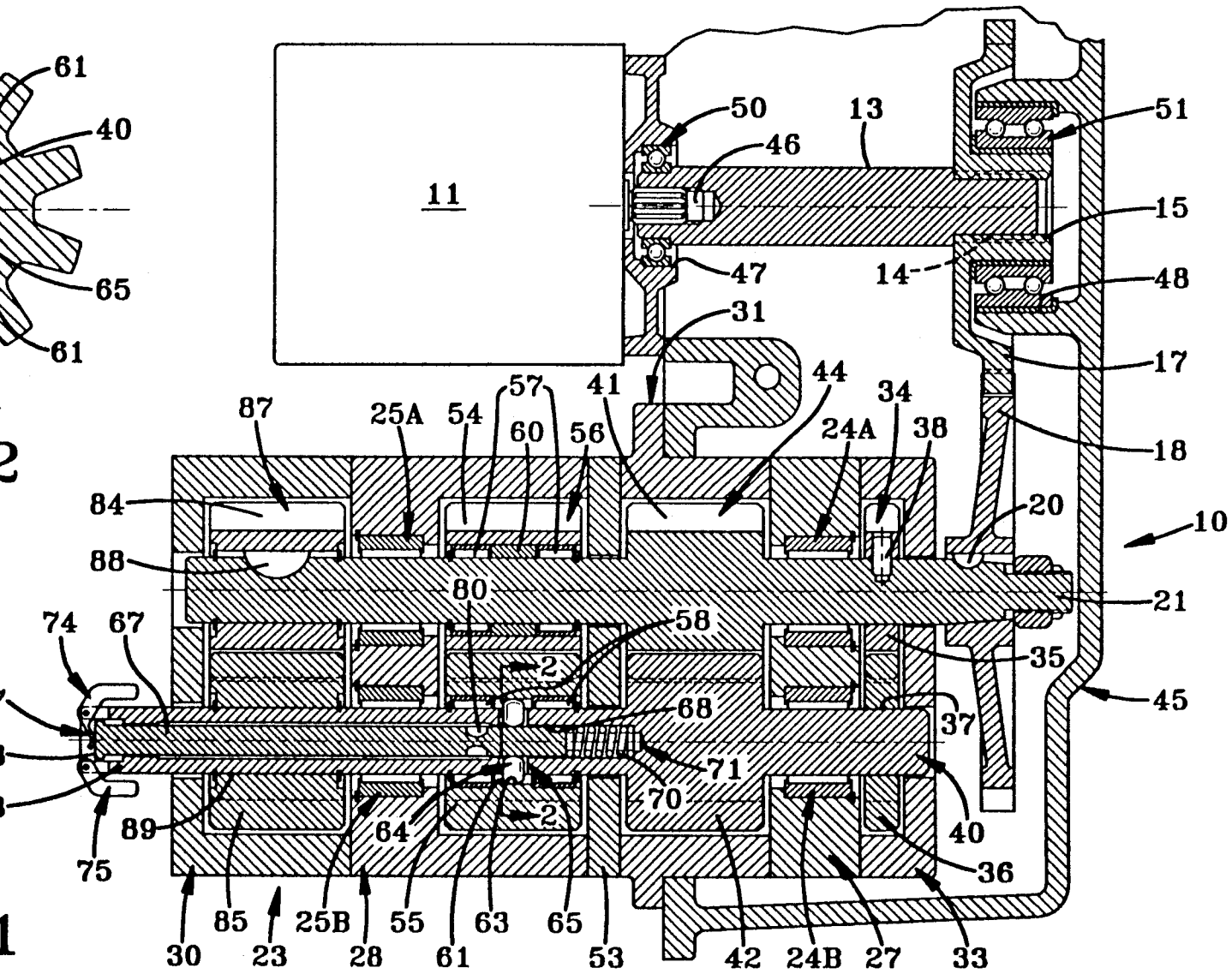
FIG. 1 is a partially diagrammatic, elevational view of a two stage pump incorporating the concepts of the present invention; and, FIG. 2 is an enlarged section taken substantially along line 2—2 of FIG. 1.

One representative form of a two stage pump assembly embodying the concepts of the present invention is designated generally by the numeral 10 on the accompanying drawings. The representative two stage pump assembly 10 is continuously driven at a rotary speed proportional to engine output speed, or the transmission input speed. The engine, transmission and control are conventional units, the construction of each of which is well known. As such, the engine, transmission and control are represented by a single box, the components being individually, and collectively, identified by the numeral 11. The two stage hydraulic pump is operatively connected to the engine/transmission/control 11 by a pump input shaft 13.

The control component 11 is preferably of the electro-hydraulic type which incorporates valves and an electronic processor such as a digital computer. The transmission component 11 includes a plurality of gear members that are controlled by fluid operated friction devices such as clutches or brakes to provide a plurality of drive ratios between the input and output of the transmission in a well known manner. These friction devices require a source of pressurized fluid that is provided by the two stage pump 10. The pump 10 must also provide lubrication oil for the shafts and bearings in the transmission.

The pump input shaft 13 has a spline 14 that is drivingly engaged with a spline 15 on a pump input drive gear 17. The pump input drive gear 17 is, in turn, meshingly engaged with a pump driven gear 18. A key 20 may be employed to effect a driving connection between the pump driven gear 18 and a pump drive shaft 21. The pump drive shaft 21 is deemed to be a component of the two stage pump 10. The two stage pump 10 has a multi-section housing, identified generally by the numeral 23, within which the pump drive shaft 21 is rotatably supported. As depicted, the pump drive shaft 21 may be supported on needle, or roller, bearings 24A and 25A which are positioned in a separator plate 27 and an intermediate sub-housing 28, respectively. The separator plate 27 and the intermediate sub-housing 28 are components of the multi-section housing 23. In addition, the housing 23 also includes an end sub-housing 30, a support sub-housing 31 and a scavenging pump sub-housing 33. The components of the multi-section housing 23 are secured together by a plurality of threaded fasteners, not shown.

Disposed within the scavenging pump sub-housing 33 is a scavenging pump 34 that is comprised of meshing gears 35 and 36. The gear 35 is drivingly connected to the pump shaft 21, as by a pin 38, and the gear 36 is rotatably supported on a pump driven shaft 40 which is also rotatably supported in both the separator plate 27 and the intermediate sub-housing 28, as by needle, or roller, bearings 24B and 25B. The pin 38 may be spring loaded into driving relation with the gear 35 to provide for ease of assembly. The shaft 40 is hardened and ground to provide a bearing surface for the gear 37. The scavenging pump 34 is a low pressure pump which is operable to return oil from lower portions of the transmission and final drive housing of a vehicle to the main sump in a well known manner. The porting and hydraulic lines for the scavenging pump 34 can be incorporated in either the scavenging pump subhousing 33 or the separator plate 27.

The separator plate 27 closes one side of the scavenging pump 34 and separates the scavenging pump sub-housing 33 from the support sub-housing 31 which is secured to a transmission case, or housing, 45 by conventional fastening means, not shown, to provide a base for the two stage pump 10. The case 45 also provides bearing recesses 47 and 48 for spaced bearings 50 and 51, respectively, which support the shaft 13 and the pump input drive gear 17. A pair of meshing pump gears 41 and 42 are secured to, or are formed integrally with, the pump drive shaft 21 and the pump driven shaft 40, respectively. The pump gears 41 and 42 cooperate to form one pumping portion 44 of a bifurcated, main, or first stage, of the two stage pump 10. The gears 41 and 42 also serve to rotate the pump driven shaft 40 in response to rotation of the pump drive shaft 21. The output of hydraulic fluid from pumping portion 44 of the first stage in the two stage pump 10 may be directed through conventional porting, not shown, in the separator plate 27 or the support sub-housing 31 to the control portion 11. Pumping portion 44 is continually driven whenever the output shaft 46 of the engine/transmission/control 11 is rotating and will, therefore, provide a continuous supply of hydraulic fluid for the transmission and control 11.

The intermediate sub-housing 28 is spaced from the support sub-housing 31 by a thin divider plate 53 which provides a side sealing surface for a pair of second stage pump gears 54 and 55 which are disposed in meshing relation in the intermediate housing 28. The second stage pump gears 54 and 55 are supported on the shafts 21 and 40, respectively, by respective needle bearings 57 and 58 to form the second stage 56 of the two stage pump 10. The needle bearing 57 has a separator bushing 60 disposed between spaced rows of needles. The needles of the bearing 58 are separated by drive tabs 61 formed on the inner periphery 63 of the pump gear 55. The drive tabs 61 are also engageable by drive tangs 64 which are slidably disposed for radial movement in slots 65 formed in the pump driven shaft 40. The drive tangs 64 may be balls, or, as shown, cylindrical pins with at least one, substantially semi-spherical end 66.

As depicted, the drive tangs 64 are extended radially outwardly to engage the tabs 61, by an actuating control rod 67 which is slidably disposed in a passage 68 that extends axially within the pump driven shaft 40. The actuating control rod 67 is urged to the left, as viewed in FIG. 1, by a compression spring 70 disposed in the distal end chamber 71 of the passage 68. The actuating control rod 67 will rotate with the pump driven shaft 40 and will, therefore, have a rotational speed that is proportional to the rotational speed of the output shaft 46 of the engine/transmission/control 11. A pair of centrifugal flyweights 74 and 75 are pivotally attached to the outboard, or proximal, end 73 of the pump driven shaft 40. The flyweight 74 has a spring arm 77 which abuts the outboard, or proximal, end 78 of the actuating control rod 67. If desired, each flyweight 74 and 75 can incorporate a spring arm. Rotation of the shaft 40 will cause the flyweights 74 and 75 to be urged, by centrifugal force, pivotally outwardly, thereby applying an axial force to the actuating control rod 67 through the spring arm 77. When the axial force on the control rod 67 is greater than the force in the compression spring 70, the control rod 67 will move axially to present recesses 80 to the drive tangs 64, thereby permitting sufficient radially inward movement of the drive tangs 64 that they will withdraw from the drive tabs 61. When the drive tangs 64 are thus withdrawn from the drive tabs 61, the second stage pump gear 55 will be drivingly disengaged from the pump driven shaft 40.

Figure 2:
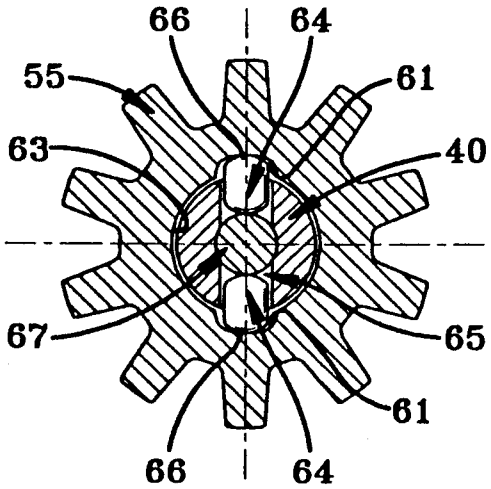

As best seen in FIG. 2, the configuration of the drive tabs 61 on the inner periphery 63 of the pump gear 55 substantially matches the curvature presented by the end 66 of each drive tang 64. This configuration assures that the reactive force resulting from the resistance applied against rotation of the pump gear 55 by the hydraulic fluid being pumped will translate the drive tangs 64 radially inwardly out of driving engagement with the pump gear 55.

On the contrary, when the drive tangs 64 are engaged within the drive tabs 61, the second stage pump gears 54 and 55 cooperate to form the second stage 56 of the two stage pump 10. The second stage 56 delivers oil through the intermediate sub-housing 28 to the control portion 11 for use by the transmission portion 11. When the drive tangs 64 are released from the drive tabs 61, as by recession of the drive tangs 64 into the notches 80, the second stage pump gears 54 and 55 will no longer receive power from the pump driven shaft 40, and they will rest freely on their respective shafts 21 and 40. The amount of oil supplied by the two stage pump 10 will be reduced to a volume sufficient to supply the systems and the losses generally associated with the second stage pumps of the prior art will be eliminated.

The end sub-housing 30 encloses a pair of meshing pump gears 84 and 85 which cooperate to form the second pumping portion 87 of the bifurcated, first stage in the two stage pump 10. The hydraulic fluid flow from the first and second pumping portions 44 and 87 of the first stage in the two stage pump 10 combine to provide a continuous supply of hydraulic fluid to the transmission and control portions 11. Bifurcation of the first stage serves to assist in the balance of the forces acting on the shafts 21 and 40.

The pump gear 84 is drivingly connected, as by a key 88, to the pump drive shaft 21 for continuous rotation therewith. The pump gear 85 may be rotatably supported on the shaft 40. If desired, the pump gear 85 can be supported on a bushing. However, it is considered that a ground and polished surface 89 on the shaft 40 will be sufficient for appropriate engagement between the shaft 40 and the pump gear 85 inasmuch as relative movement therebetween will be slight, or non-existent.

From the foregoing description it will be apparent to those skilled in the art that the present invention will reduce the losses associated with the prior art two stage pumps. It should also be apparent that the actuating control rod 67 can be regulated by introducing a fluid under pressure into the distal chamber 71 in which the spring 70 is disposed. The pressure can complement the spring 70 or replace it completely. Those skilled in the art will be aware of the many types of pressure controls that can be used to establish the axial positioning of the actuating control rod 67. For example, a pressure signal indicative of the operating temperature of the transmission can be provided to energize the second stage 53. Likewise, a pressure signal indicating the energization of a hydraulic retarder can be utilized to actuate the second stage 53. The end 77 of the control rod 67 can be enclosed in the shaft and acted upon by a governor pressure instead of the flyweights 74 and 75, or other control pressure functions can be used as desired in a specific instance. Thus, it should be apparent that control devices, other than a resilient spring member 77 and centrifugal flyweights 74 and 75 can be incorporated within the above teaching.

The foregoing description of the exemplary embodiment of the invention has been presented for the purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A two stage pump comprising:

a first pump assembly continuously drivingly connected to a rotatable input shaft;

a second pump assembly being selectively operable in conjunction with said first pump assembly;

a selectively operable speed sensitive means having a longitudinal axis and having drive tang means being positionable radially with respect to said longitudinal axis for selectively engaging and disengaging a portion of the second pump assembly for operatively connecting the second pump assembly to the input shaft.

2. A two stage pump, as set forth in claim 1, wherein:

said speed sensitive means has control means being positionable axially along the longitudinal axis of said speed sensitive means for selectively determining the radial position of the drive tang means.

3. A two stage pump, as set forth in claim 2, wherein:

said speed sensitive means includes resilient means urging said axially positionable control means to enforce engagement of the drive tang means with said portion of said second pump assembly.

4. A two stage pump, as set forth in claim 2, wherein:

said speed sensitive means includes centrifugal flyweight means for urging said axially positionable control means to disengage said drive tang means from the portion of said second pump assembly.

5. A two stage pump comprising:

a first pump assembly continuously drivingly connected to a rotatable input shaft;

a second pump assembly being selectively operable in conjunction with said first pump assembly;

selectively operable drive control means having a longitudinal axis and having drive tang means being positionable radially with respect to said longitudinal axis for selectively engaging and disengaging a portion of the second pump assembly for operatively connecting the second pump assembly to the input shaft; and, operating means including a control member movable axially along said longitudinal axis for positioning said drive tang means; and, means for selectively controlling the axial position of said control member.

* * * * *